US011939034B1

(12) United States Patent
Sun et al.

(10) Patent No.: US 11,939,034 B1
(45) Date of Patent: Mar. 26, 2024

(54) DEEP-SEA CRAWLING ROBOT AND CRAWLING METHOD THEREOF

(71) Applicant: Qingdao Institute of Marine Geology, Qingdao (CN)

(72) Inventors: Zhilei Sun, Qingdao (CN); Bin Zhai, Qingdao (CN); Nengyou Wu, Qingdao (CN); Wei Geng, Qingdao (CN); Yunbao Sun, Qingdao (CN); Gang Dong, Qingdao (CN); Xilin Zhang, Qingdao (CN); Dong Zhang, Qingdao (CN); Qingsheng Liu, Qingdao (CN); Shixing Li, Qingdao (CN)

(73) Assignee: Qingdao Institute of Marine Geology, Qingdao (CN)

( * ) Notice: Subject to any disclaimer, the term of this patent is extended or adjusted under 35 U.S.C. 154(b) by 0 days.

(21) Appl. No.: 18/525,888

(22) Filed: Dec. 1, 2023

(30) Foreign Application Priority Data

Dec. 5, 2022 (CN) ..... 202211547375.0

(51) Int. Cl.

| | |
|---|---|
| ***B63G 8/00*** | (2006.01) |
| ***B63G 8/08*** | (2006.01) |
| ***B63G 8/22*** | (2006.01) |
| ***E21C 50/00*** | (2006.01) |

(52) U.S. Cl.
CPC ..... *B63G 8/001* (2013.01); *B63G 8/08* (2013.01); *B63G 8/22* (2013.01); *E21C 50/00* (2013.01); *B63G 2008/004* (2013.01)

(58) Field of Classification Search
CPC ..... B63G 8/001; B63G 2008/002; B63G 2008/004; B63G 2008/005; B63G 8/08; B63G 8/22; B63G 8/24; E21C 50/00; E21C 50/02; E02F 3/8858; E02F 3/8866; E02F 5/006
See application file for complete search history.

(56) References Cited

U.S. PATENT DOCUMENTS

| | | | | |
|---|---|---|---|---|
| 9,074,386 | B2 * | 7/2015 | Hong | E02F 3/9281 |
| 9,334,734 | B2 * | 5/2016 | Hong | E02F 3/907 |
| 9,874,000 | B2 * | 1/2018 | Heiler | E02F 3/8866 |

FOREIGN PATENT DOCUMENTS

| | | | | |
|---|---|---|---|---|
| CN | 112223964 A | * | 1/2021 | B60F 3/0015 |
| CN | 112726716 A | * | 4/2021 | B60F 3/8866 |

* cited by examiner

*Primary Examiner* — Ajay Vasudeva
(74) *Attorney, Agent, or Firm* — Bayramoglu Law Offices LLC

(57) ABSTRACT

A deep-sea crawling robot and a crawling method thereof are provided. The deep-sea crawling robot includes a crawling robot body and a countertop, wherein a top of the crawling robot body is fixedly connected to the countertop, left and right sides of a bottom of the crawling robot body are respectively provided with crawler belts, and left and right sides of the countertop are respectively provided with weight-increasing auxiliary crawling mechanisms; and an outer plate is fixedly connected to a front side or back side of the countertop, a multifunctional propelling mechanism is arranged on the outer plate, and a rapid dewatering mechanism is arranged in a chamber of the countertop. The deep-sea crawling robot can not only accelerate the propulsion and crawling speed when it is on the seabed but also further enhance its stability during the crawling process on the seabed.

15 Claims, 5 Drawing Sheets

DEEP-SEA CRAWLING ROBOT AND CRAWLING METHOD THEREOF

CROSS-REFERENCE TO THE RELATED APPLICATION

This application is based upon and claims priority to Chinese Patent Application No. 202211547375.0 filed on Dec. 5, 2022, the entire content of which is incorporated herein by reference.

TECHNICAL FIELD

The invention relates to the technical field of deep-sea mining vehicles, in particular to a deep-sea crawling robot and a crawling method thereof.

BACKGROUND

Deep-sea exploration crawling robot platform is an intelligent high-precision operation device designed for current deep-sea natural gas hydrates, polymetallic nodules, and hydrothermal sulfide ore deposits. The platform adopts a modular design and features a dual-layer structure with a floating body and a walking operation chassis, allowing for both floating and underwater walking operation modes.

Due to the limited weight, existing deep-sea crawling robots are subjected to significant buoyancy from water as they descend to the seabed, reducing their stability during operation on the seabed. This hinders the functioning of instruments on the crawling robot. Additionally, the environment in the deep sea is complex, further increasing the difficulty of operation for the crawling robot on the seabed, thus resulting in low utility value.

SUMMARY

The invention aims at overcoming the defects in the prior art, and provides a deep-sea crawling robot and a crawling method thereof, which can not only accelerate the propulsion and crawling speed of the crawling robot when it is on the seabed but also further enhance its stability during the crawling process on the seabed, improving the utility value of the deep-sea crawling robot.

The technical scheme of the invention is as follows. A deep-sea crawling robot includes a crawling robot body and a countertop, wherein a top of the crawling robot body is fixedly connected to the countertop, left and right sides of a bottom of the crawling robot body are respectively provided with crawler belts, and left and right sides of the countertop are respectively provided with weight-increasing auxiliary crawling mechanisms; an outer plate is fixedly connected to a front side or back side of the countertop, and a multifunctional propelling mechanism is arranged on the outer plate; shaft plates are respectively arranged in the middle of front and back sides of a top end of the countertop, two parallel turning shafts are connected between the two shaft plates, and two second drive motors are fixedly connected to the outside of the shaft plate on one side; output shafts of the second drive motors are respectively connected to the turning shafts through couplings, and the other end of the turning shaft is rotatably connected to the other shaft plate; and turning frames are fixedly connected to the axial outside of the two turning shafts, a chamber is formed between the two turning frames and the countertop, and a rapid dewatering mechanism is arranged in the chamber of the countertop.

In the present invention, the weight-increasing auxiliary crawling mechanism includes two symmetrical water storage frames and two symmetrical mounting frames, a chamber is formed when the two water storage frames are docked, and the two mounting frames are fixedly connected to side faces of the countertop respectively; a bottom of the mounting frame is hinged to a top of a hydraulic cylinder, a bottom of the hydraulic cylinder is hinged to the outside of the water storage frame, and tops of the two water storage frames are fixedly connected to rotating cylinders respectively; the two rotating cylinders are located between the two mounting frames, the rotating cylinders are respectively sleeved on fixed shafts in a rolling manner, one end of the fixed shaft is fixedly connected to the countertop, and the other end of the fixed shaft is fixedly connected to a fixed frame; and roller frames are fixedly connected to bottoms of the two water storage frames respectively, a bottom of the roller frame is provided with a plurality of ground-contact moving rollers at intervals along the crawling direction of the crawling robot, the ground-contact moving rollers are rotatably connected to the roller frames, connecting plates are fixed to the middle of the two roller frames, counterweight frames are fixed on the two connecting plates, and counterweight plates are inserted into the counterweight frames.

The two roller frames, the ground-contact moving rollers on the two roller frames, the connecting plates, the counterweight frames, and the counterweight plates are all symmetrically arranged.

The multifunctional propelling mechanism includes lifting rails, a plurality of propellers and a first drive motor, the two vertical lifting rails are fixed on a top surface of the outer plate, and lifting sliders are arranged in the lifting rails; a bottom of the lifting slider is connected to a bottom wall of the lifting rail through a connecting spring, the two lifting sliders are fixedly connected through a shaft bracket, and the shaft bracket is fixedly connected to the outside of the lifting slider; a rotating shaft is arranged in the shaft bracket, two ends of the shaft bracket are rotatably connected to the rotating shaft, and a rotating roller is fixed on the annular outside of the rotating shaft; and a deflection frame is fixed on the outside of the rotating roller, the plurality of propellers are arranged in the deflection frame at intervals along the axial direction of the rotating shaft, the first drive motor is fixed to one side of the shaft bracket, and an output shaft of the first drive motor is connected to the rotating shaft through a coupling.

The rapid dewatering mechanism is arranged in the middle of the chamber of the countertop, the rapid dewatering mechanism includes two hollow plates which are obliquely arranged, a support frame is arranged between the two hollow plates, and the support frame is fixed on the countertop; blowers are fixed to two sides of the support frame respectively, an air delivery end of the blower communicates with the interior of the hollow plate, a plurality of electric heating tubes are evenly arranged inside the hollow plate, and a plurality of blow holes are evenly distributed on a side, facing the chamber of the countertop, of each hollow plate; and a bottom of the countertop is evenly provided with a plurality of drainage holes.

Support plates are fixedly connected to two ends of a lower surface of the countertop respectively, and the support plates are fixedly connected to a top surface of the crawling robot body.

Extension rods are respectively fixed to front and back ends of left and right bottoms of the countertop, inner ends of the extension rods are fixedly connected to the countertop, mechanical legs are connected to bottoms of outer ends of the extension rods, and a plurality of ground-contact claws are annularly distributed at a bottom of the mechanical leg; and an annular mounting plate is fixed to the outside of the mechanical leg above the ground-contact claws, a plurality of embedded claws are evenly fixed on a bottom surface of the annular mounting plate, and the embedded claws annularly surround the ground-contact claws.

The invention further provides a crawling method of the above deep-sea crawling robot, including the following steps:

S1: when the crawling robot moves forward on a sea surface, the hydraulic cylinders are adjusted to drive the water storage frames to rotate in the horizontal direction, gradually aligning the two water storage frames, which increases the contact area between the crawling robot body and the sea surface; at this point, the propellers are in parallel with the outer plate, and the propellers are activated to accelerate the forward movement of the crawling robot;

S2: during the descent of the crawling robot in the sea, the hydraulic cylinders drive the water storage frames to rotate in the vertical direction, gradually closing a gap between the two water storage frames; and during the closing process, the water storage frames are filled with a large amount of seawater, and the seawater inside the chamber formed by the docked water storage frames increases the weight of the crawling robot;

meanwhile, the propellers move to the tops of the lifting rails, and the first drive motor is started to drive the propellers for angle adjustment, tilting the propellers towards the seabed direction;

S3: when the crawling robot crawls on the seabed, the ground-contact moving rollers and the mechanical legs make contact with the seabed, and the ground-contact claws and the embedded claws increase the frictional force during the movement of the crawling robot; and S4: when the crawling robot works, the second drive motors are started to drive the turning frames to rotate, exposing the machinery inside the chamber of the countertop to seawater, and then the machinery starts to perform data measurement and other tasks.

In the present invention, in S2, after the propellers are started, forces in two directions are generated, the thrust force in the horizontal direction accelerates the crawling of the crawling robot when it is on the seabed, and the thrust force in the vertical direction compresses the crawling robot.

The invention has the following beneficial effects:

(1) by incorporating the weight-increasing auxiliary crawling mechanisms, when the crawling robot is in a descending state in the sea, the chamber formed after the two water storage frames are docked is filled with a large amount of seawater, which increases the weight of the crawling robot and improves its stability on the seabed, ensuring that the machinery in the countertop can work stably; after the crawling robot makes contact with the seabed, the ground-contact moving rollers make contact with the seabed, increasing the contact area between the crawling robot and the seabed, further enhancing the stability of the crawling robot while crawling on the seabed; when the crawling robot advances on the sea surface, the two water storage frames are separated and in a horizontal position, increasing the contact area between the crawling robot and the sea surface, thus improving the stability of the crawling robot during propulsion and enhancing its utility value;

(2) by incorporating the multifunctional propelling mechanism, when the crawling robot advances on the sea surface, the propellers are parallel to the outer plate, and by starting the propellers, the crawling robot is accelerated; when the crawling robot submerges, the propellers move to the tops of the lifting rails, and the first drive motor is started to drive the propellers to incline towards the seabed, not only accelerating the movement of the crawling robot on the seabed but also further enhancing its stability during crawling on the seabed; and (3) by incorporating the rapid dewatering mechanism, after the crawling robot reaches the seabed, the machinery in the chamber of the countertop is exposed to seawater to work, and then the rapid dewatering mechanism accelerates the removal of water from the outside of the machinery in the chamber, and facilitates draining of water from the countertop through the drainage holes, thus reducing the time of corrosion by seawater and protecting the machinery.

Figure 1:
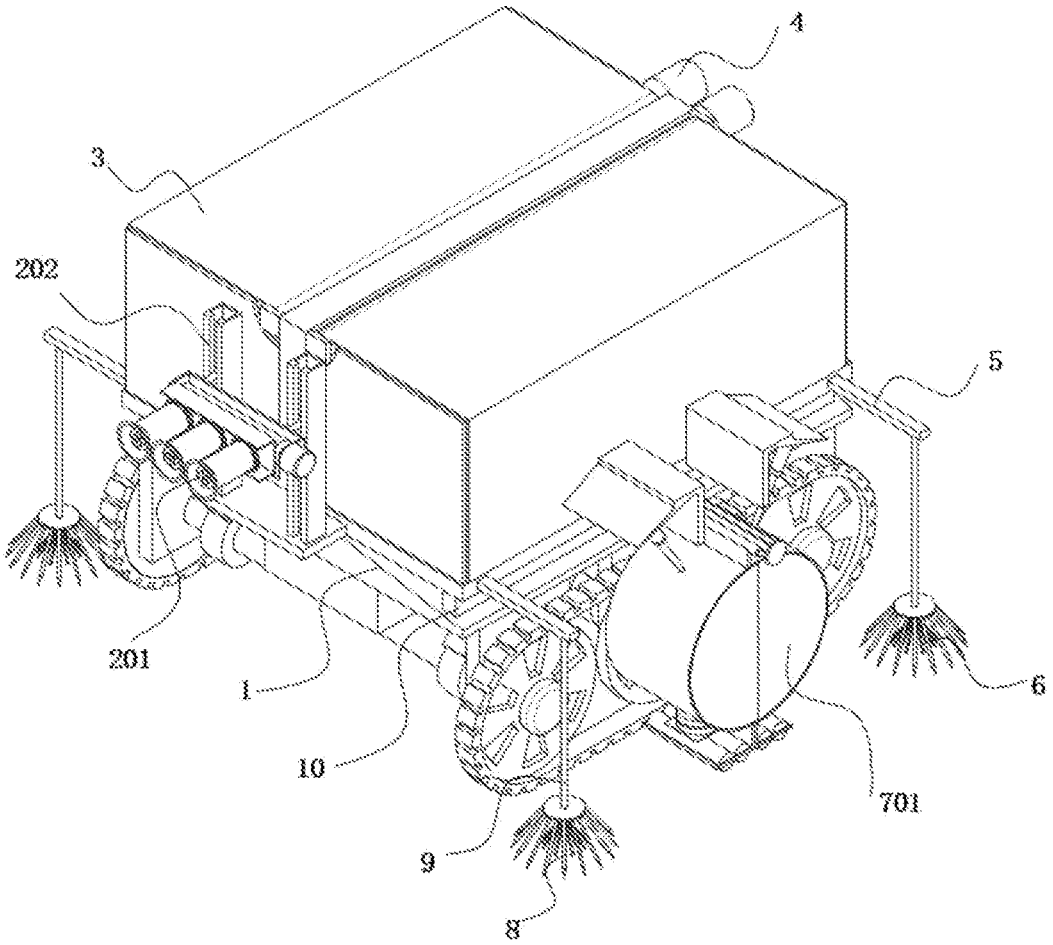
FIG. 1 is a diagram of an overall structure of a deep-sea crawling robot proposed by the invention.

Included in the drawings are: 1. crawler robot body; 2. multifunctional propelling mechanism; 201. propeller; 202. lifting rail; 203. connecting spring; 204. lifting slider; 205. shaft bracket; 206. rotating shaft; 207. annular mounting frame; 208, deflection frame; 209. first drive motor; 210. rotating roller; 3. turning frame; 4. second drive motor; 5. extension rod; 6. ground-contact claw; 7. weight-increasing auxiliary crawling mechanism; 701, water storage frame; 702. mounting frame; 703. counterweight frame; 704. ground-contact moving roller; 705. counterweight plate; 706. hydraulic cylinder; 707. rotating cylinder; 708. fixed frame; 709. fixed shaft; 710. roller frame; 711. connecting plate; 8. embedded claw; 9. mechanical leg; 10. support plate; 11. outer plate; 12. countertop; 13. drainage hole; 14. turning shaft; 15. shaft plate; 16. rapid dewatering mechanism; 1601. hollow plate; 1602. support frame; 1603. blow hole; 1604. blower; 1605. electric heating tube; 17. annular mounting plate.

DETAILED DESCRIPTION OF THE EMBODIMENTS

In order to make the above objects, features and advantages of the invention more obvious and easy to understand, the specific embodiments of the invention will be described in detail below with reference to the attached drawings.

In the following description, specific details are set forth in order to fully understand the invention. However, the invention can be implemented in many other ways different from those described here, and those skilled in the art can make similar extension without violating the connotation of the invention. Therefore, the invention is not limited by the specific embodiments disclosed below.

As shown in FIGS. 1-7, a deep-sea crawling robot provided by the invention includes a crawling robot body 1 and a countertop 12, wherein a top of the crawling robot body 1 is fixedly connected to the countertop 12, left and right sides of a bottom of the crawling robot body 1 are respectively provided with crawler belts, support plates 10 are fixedly connected to two ends of a lower surface of the countertop 12 respectively, the support plates 10 are fixedly connected to a top surface of the crawling robot body 1, and left and right sides of the countertop 12 are respectively provided with weight-increasing auxiliary crawling mechanisms 7; and extension rods 5 are respectively fixed to front and back ends of left and right bottoms of the countertop 12, inner ends of the extension rods 5 are fixedly connected to the countertop 12, mechanical legs 9 are connected to bottoms of outer ends of the extension rods 5, and a plurality of ground-contact claws 6 are annularly distributed at a bottom of the mechanical leg 9. Further, an annular mounting plate 17 is fixed to the outside of the mechanical leg 9 above the ground-contact claws 6, a plurality of embedded claws 8 are evenly fixed on a bottom surface of the annular mounting plate 17, and the embedded claws 8 annularly surround the ground-contact claws 6. When the crawling robot body 1 crawls on the seabed, the mechanical legs 9 make contact with the seabed, and the ground-contact claws 6 and the embedded claws 8 increase the frictional force during the movement of the crawling robot body 1. An outer plate 11 is fixedly connected to a front side or back side of the countertop 12, and a multifunctional propelling mechanism 2 is arranged on the outer plate 11; shaft plates 15 are respectively arranged in the middle of front and back sides of a top end of the countertop 12, two parallel turning shafts 14 are connected between the two shaft plates 15, and two second drive motors 4 are fixedly connected to the outside of the shaft plate 15 on one side; output shafts of the second drive motors 4 are respectively connected to the turning shafts 14 through couplings, and the other end of the turning shaft 14 is connected to the other shaft plate 15 through a bearing; and turning frames 3 are fixedly connected to the axial outside of the two turning shafts 14, a chamber is formed between the turning frames 3 and the countertop 12 for accommodating machinery used for performing data measurement and other tasks, a rapid dewatering mechanism 16 is arranged in the chamber of the countertop 12, and a bottom of the countertop 12 is evenly provided with a plurality of drainage holes 13.

Figure 2:
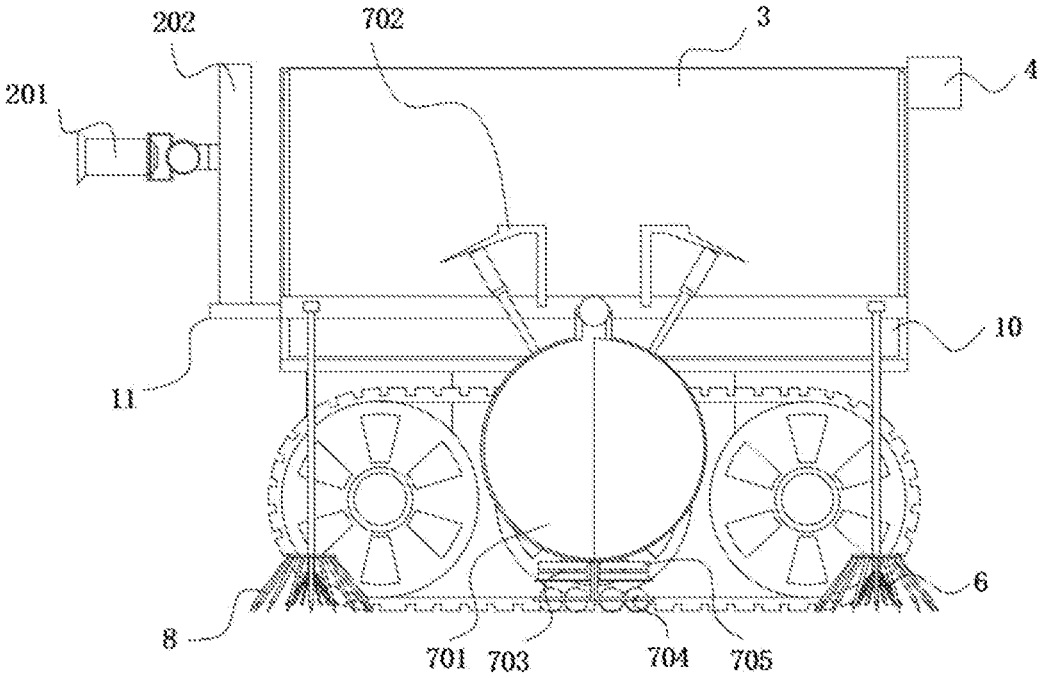
FIG. 2 is a front view of an overall structure of a deep-sea crawling robot proposed by the invention.
Figure 3:
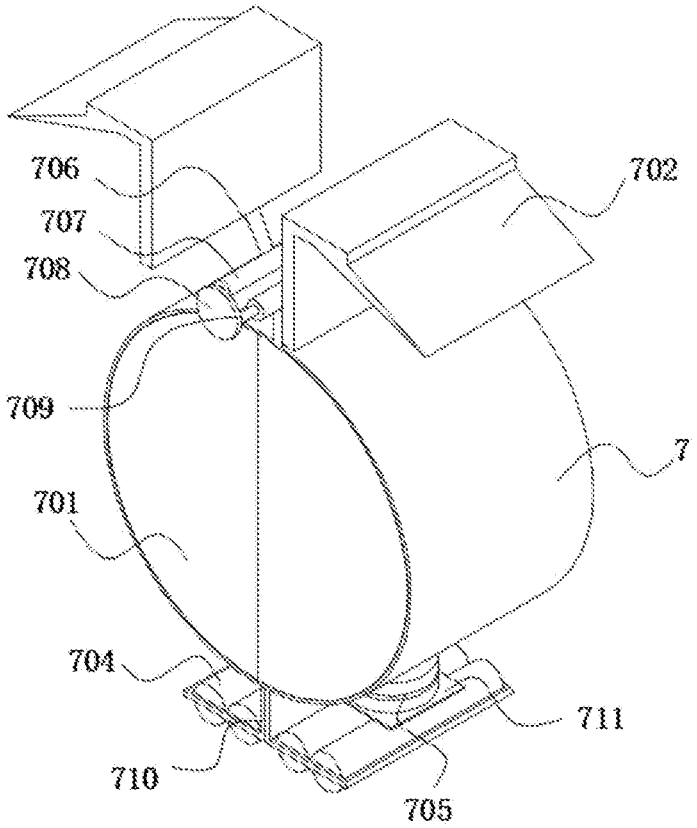
FIG. 3 is a diagram of a weight-increasing auxiliary crawling mechanism of a deep-sea crawling robot proposed by the invention.

As shown in FIGS. 1-3, the weight-increasing auxiliary crawling mechanism 7 includes two symmetrical water storage frames 701 and two symmetrical mounting frames 702, a closed chamber is formed when the two water storage frames are docked, and the two mounting frames 702 are fixedly connected to side faces of the countertop 12 respectively; hydraulic cylinders 706 are hinged to bottoms of the mounting frames 702 respectively, a cylinder top of the hydraulic cylinder 706 is hinged to the mounting frame 702, and a piston bottom of the hydraulic cylinder 706 is hinged to the outside of the water storage frame 701; tops of the two water storage frames 701 are fixedly connected to rotating cylinders 707 respectively, the two rotating cylinders 707 are located between the two mounting frames 702, the rotating cylinders 707 are respectively sleeved on fixed shafts 709, and the rotating cylinders 707 can rotate around the fixed shafts 709; and an inner end of the fixed shaft 709 is fixedly connected to the countertop 12, and an outer end of the fixed shaft 709 is fixedly connected to a fixed frame 708. Therefore, the tops of the two water storage frames 701 can rotate around the fixed shafts 709.

Roller frames 710 are fixedly connected to bottoms of the two water storage frames 701 respectively, a bottom of the roller frame 710 is provided with a plurality of ground-contact moving rollers 704 at intervals along the crawling direction of the crawling robot, two ends of the ground-contact moving roller 704 are rotatably connected to the roller frames 710 through bearings respectively, connecting plates 711 are fixed to the middle of the two roller frames 710, counterweight frames 703 are fixed on the two connecting plates 711, and counterweight plates 705 are inserted into the counterweight frames 703. The two roller frames 710, the ground-contact moving rollers 704 on the two roller frames 710, the connecting plates 711, and the counterweight plates 705 are all symmetrically arranged.

By incorporating the weight-increasing auxiliary crawling mechanisms 7, when the crawling robot is in a descending state in the sea, the hydraulic cylinders 706 extend and drive the water storage frames 701 to rotate downwards; as a result, the two water storage frames 701 gradually close and form a chamber that is filled with a large amount of seawater; this added seawater, combined with the weight of the crawling robot itself, increases the overall weight of the crawling robot and enhances its stability on the seabed, ensuring that the machinery in the countertop 12 can work stably; after the crawling robot makes contact with the seabed, the ground-contact moving rollers 704 make contact with the seabed, increasing the contact area between the crawling robot and the seabed, further enhancing the stability of the crawling robot while crawling on the seabed; and when the crawling robot advances on the sea surface, the hydraulic cylinders 706 are adjusted to retract, causing the water storage frames 701 to rotate upwards and gradually return to a horizontal position, increasing the contact area between the crawling robot and the sea surface, thus improving the stability of the crawling robot during propulsion and enhancing its utility value.

Figure 4:
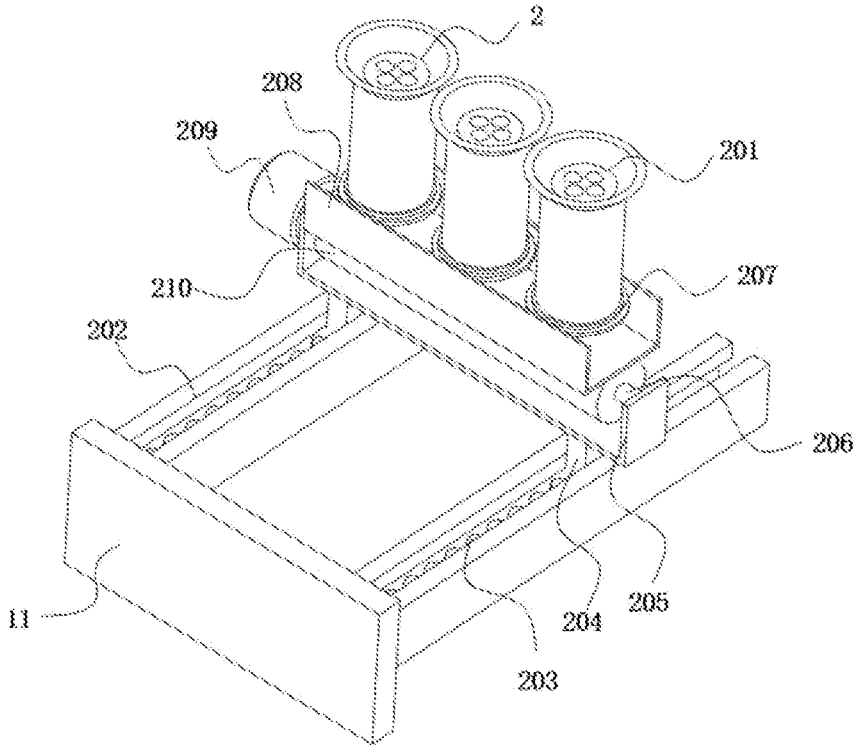
FIG. 4 is a diagram of a multifunctional propelling mechanism of a deep-sea crawling robot proposed by the invention.
Figure 5:
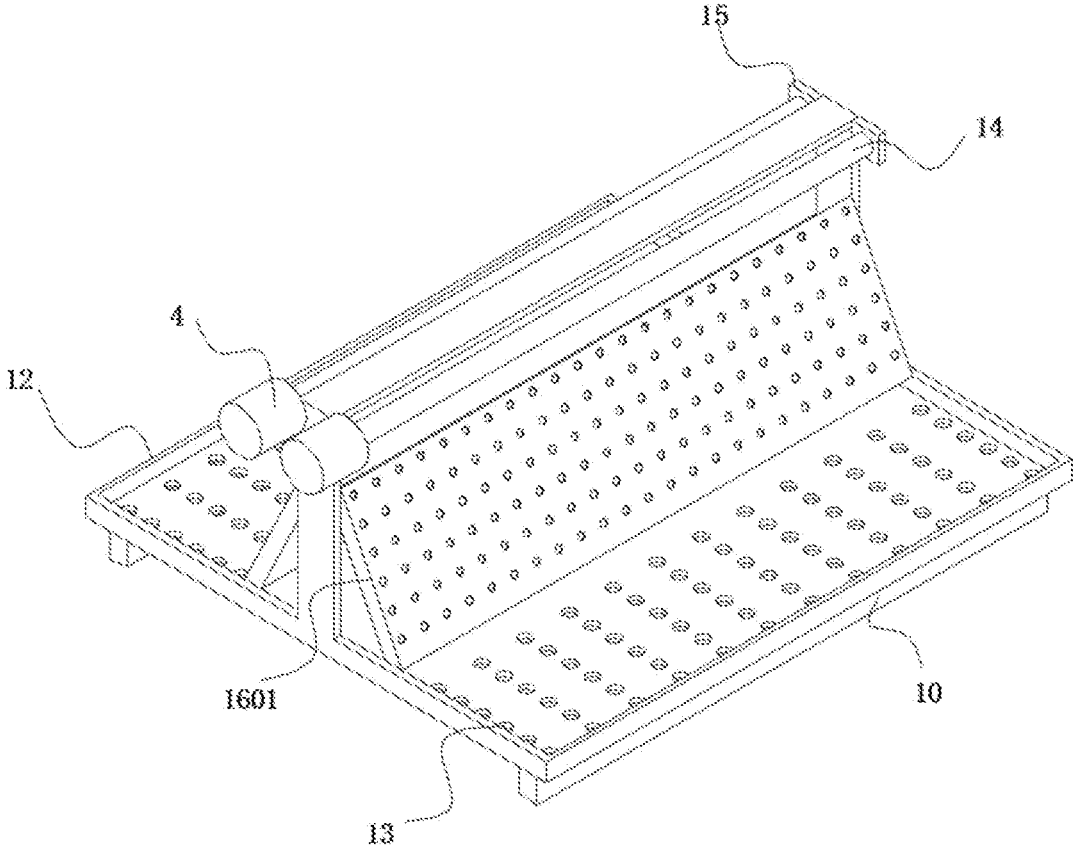
FIG. 5 is a structural diagram of a countertop of a deep-sea crawling robot proposed by the invention.

As shown in FIGS. 1, 2 and 4, the multifunctional pushing mechanism 2 includes lifting rails 202, a plurality of propellers 201 and a first drive motor 209, the two parallel lifting rails 202 are fixed on a top surface of the outer plate 11, and lifting sliders 204 are arranged in the lifting rails 202; a bottom of the lifting slider 204 is connected to a bottom wall of the lifting rail 202 through a connecting spring 203, the two lifting sliders 204 are fixedly connected through a shaft bracket 205, and the shaft bracket 205 is fixedly connected to the outside of the lifting slider 204; a rotating shaft 206 is arranged in the shaft bracket 205, two ends of the shaft bracket 205 are rotatably connected to the rotating shaft 206, and a rotating roller 210 is fixed on the annular outside of the rotating shaft 206; and a deflection frame 208 is fixed on the outside of the rotating roller 210, the plurality of propellers 201 are arranged in the deflection frame 208 at intervals along the axial direction of the rotating shaft, the propellers 201 are connected to the deflection frame 208 through an annular mounting frame 207, the first drive motor 209 is fixed to one side of the shaft bracket 205, an output shaft of the first drive motor 209 is connected to the rotating shaft 206 through a coupling, and the other end of the rotating shaft 206 is connected to the shaft bracket 205 through a bearing.

By incorporating the multifunctional propelling mechanism, when the crawling robot advances on the sea surface, the propellers 201 compress the connecting spring 203 under the action of gravity, and the propellers 201 move slowly towards the outer plate 11. At this point, the propellers 201 are parallel to the outer plate 11, and the propellers 201 are started to accelerate the crawling robot. When the crawling robot submerges, the gravity of the propellers 201 is counteracted by the buoyancy of the seawater, causing the connecting spring 203 to bounce upward. The propellers 201 are pushed to the tops of the lift rails 202. At this point, the first drive motor 209 is started to drive the rotating shaft 206 to rotate, causing the angle of the propellers 201 fixed on an outer surface of the rotating shaft 206 to change. When the propellers 201 are rotated from a horizontal position to a direction towards the seabed at an angle of 45 degrees from the horizontal direction, the propellers 201 are started and generate forces in two directions, the thrust force in the horizontal direction accelerates the crawling of the crawling robot when it is on the seabed, and the thrust force in the vertical direction compresses the crawling robot, making it more closely contact the seabed and further improving the stability of the crawling robot during the crawling process on the seabed.

Figure 6:
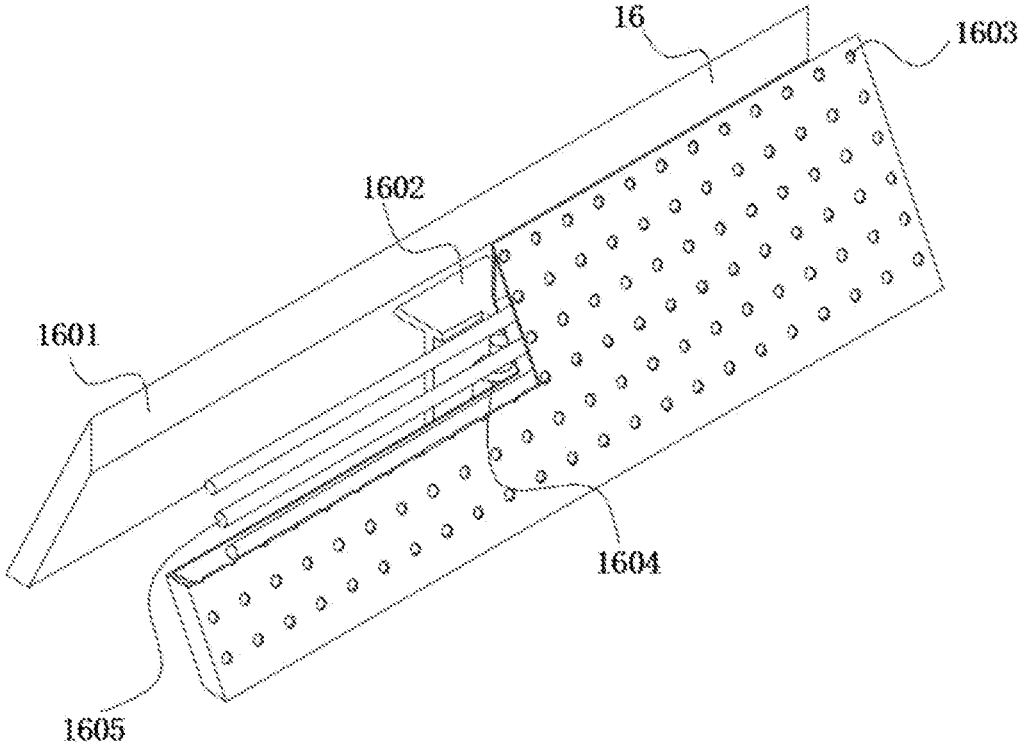
FIG. 6 is a diagram of a rapid dewatering mechanism of a deep-sea crawling robot proposed by the invention.
Figure 7:
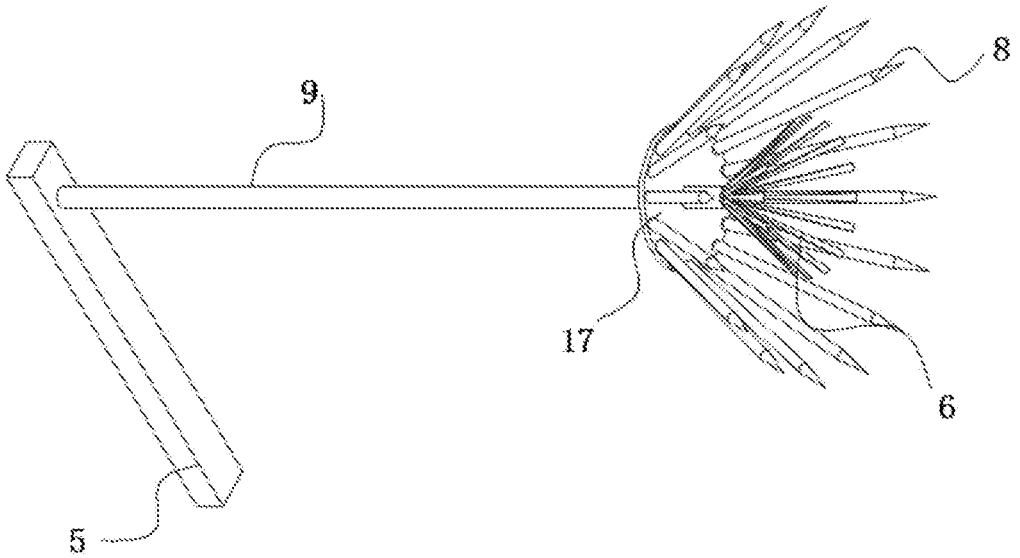
FIG. 7 is a structural diagram of a ground-contact mechanical leg of a deep-sea crawling robot proposed by the invention.

As shown in FIG. 6, the rapid dewatering mechanism 16 is arranged in the middle of the chamber of the countertop 12, the rapid dewatering mechanism 16 includes two hollow plates 1601 which are obliquely arranged, a support frame 1602 is arranged between the two hollow plates 1601, and the support frame 1602 is fixed on the countertop 12; blowers 1604 are fixed to two sides of the support frame 1602 respectively, an air delivery end of the blower 1604 is connected to the interior of the hollow plate 1601 through a pipeline, a plurality of electric heating tubes 1605 are evenly arranged inside the hollow plate 1601, and a plurality of blow holes 1603 are evenly distributed on a side, facing the chamber of the countertop 12, of each hollow plate 1601.

By incorporating the rapid dewatering mechanism 16, after the crawling robot reaches the seabed, the second drive motors 4 are started to drive the turning frames 3 to rotate, exposing the machinery inside the countertop 12 to seawater, and then the machinery starts to perform data measurement and other tasks. After the machinery finishes working, the blower 1604 is started and introduces gas from the surrounding environment into the hollow plate 1601. The electric heating tubes 1605 inside the hollow plate 1601 heat the gas, which is then blown out from the blow holes 1603. The heated gas accelerates the removal of water from the outside of the machinery inside the chamber, and at the same time, the blowing force helps to drain the water inside the countertop 12 through the drainage holes 13. This reduces the time of corrosion by seawater and protects the machinery.

In use, when the crawling robot moves forward on a sea surface, the hydraulic cylinders 706 are adjusted to drive the water storage frames 701 to rotate upwards, so that the two water storage frames 701 gradually move to a horizontal position, which increases the contact area between the crawling robot body 1 and the sea surface, thus improving the stability of the crawling robot. The propellers 201 compress the connecting spring 203 under the action of gravity, and move slowly towards the outer plate. At this point, the propellers 201 are parallel to the outer plate 11, and the propellers 201 are started to accelerate the crawling robot body 1. When the crawling robot descends in the sea, the hydraulic cylinders 706 drive the water storage frames 701 to rotate downwards; as a result, the two water storage frames 701 gradually close and are filled with a large amount of seawater in the closing process; and this added seawater, combined with the weight of the crawling robot body 1 itself, increases the overall weight of the crawling robot and enhances its stability on the seabed, ensuring that the machinery in the countertop 12 of the crawling robot can work stably. After the crawling robot makes contact with the seabed, the ground-contact moving rollers 704 make contact with the seabed, increasing the contact area between the crawling robot and the seabed, further enhancing the stability of the crawling robot body 1 while crawling on the seabed. At the same time, the gravity of the propellers 201 is counteracted by the buoyancy of the seawater, causing the connecting spring 203 to bounce upward. The propellers 201 move to the tops of the lift rails 202. At this point, the first drive motor 209 is started to drive the propellers 201 for angle adjustment. The propellers rotate to a direction towards the seabed. After the propellers 201 are started, forces in two directions are generated, the thrust force in the horizontal direction accelerates the crawling of the crawling robot body 1 on the seabed, and the thrust force in the vertical direction compresses the crawling robot, making it more closely contact the seabed. When the crawling robot body 1 crawls on the seabed, the mechanical legs 9 make contact with the seabed, and the ground-contact claws 6 and the embedded claws 8 increase the frictional force during the movement of the crawling robot body 1, thus enhancing its moving stability.

The invention further provides a crawling method of the above deep-sea crawling robot, including the following steps:

S1: when the crawling robot moves forward on a sea surface, the hydraulic cylinders 706 are adjusted to drive the water storage frames 701 to rotate in the horizontal direction, so that the two water storage frames 701 gradually move to a horizontal position, which increases the contact area between the crawling robot body 1 and the sea surface; at this point, the propellers 201 are parallel to the outer plate 11, and the propellers 201 are activated to accelerate the forward movement of the crawling robot;

S2: during the descent of the crawling robot in the sea, the hydraulic cylinders 706 drive the water storage frames 701 to rotate in the vertical direction, gradually closing a gap between the two water storage frames 701; and during the closing process, the water storage frames 701 are filled with a large amount of seawater, and the seawater inside the chamber formed by the docked water storage frames 701 increases the weight of the crawling robot;

at the same time, the gravity of the propellers 201 is counteracted by the buoyancy of the seawater, causing the connecting spring 203 to bounce upward. The propellers 201 move to the tops of the lift rails 202; at this point, the first drive motor 209 is started to drive the propellers 201 for angle adjustment, and the propellers 201 rotate to a direction towards the seabed; after the propellers 201 are started, forces in two directions are generated, the thrust force in the horizontal direction accelerates the crawling of the crawling robot on the seabed, and the thrust force in the vertical direction compresses the crawling robot;

S3: when the crawling robot crawls on the seabed, the mechanical legs 9 make contact with the seabed, and the ground-contact claws 6 and the embedded claws 8 increase the frictional force during the movement of the crawling robot; besides, the ground-contact moving rollers 704 make contact with the seabed, increasing the contact area between the crawling robot and the seabed; and S4: when the crawling robot works, the second drive motors 4 are started to drive the turning frames 3 to rotate, exposing the machinery inside the chamber of the countertop 12 to seawater, and then the machinery starts to perform data measurement and other tasks.

The deep-sea crawling robot and the crawling method thereof provided by the invention have been introduced in detail. In this article, specific examples are used to explain the principle and implementation of the invention, and the description of the above embodiments is only used to help understand the method of the invention and its core ideas. It should be pointed out that for those of ordinary skill in the art, multiple improvements and modifications may be made to the invention without departing from the principle of the invention, and these improvements and modifications also fall within the scope of protection of the claims of the invention. The above description of the disclosed embodiments enables those skilled in the art to implement or use the invention. Various modifications to these embodiments will be apparent to those skilled in the art, and the general principles defined herein may be implemented in other embodiments without departing from the spirit or scope of the invention. Therefore, the invention should not be limited to the embodiments shown herein, but should accord with the widest scope consistent with the principles and novel features disclosed herein.

What is claimed is:

1. A deep-sea crawling robot, comprising a crawling robot body and a countertop, wherein a top of the crawling robot body is fixedly connected to the countertop, left and right sides of a bottom of the crawling robot body are respectively provided with crawler belts, and left and right sides of the countertop are respectively provided with weight-increasing auxiliary crawling mechanisms; an outer plate is fixedly connected to a front side or back side of the countertop, and a multifunctional propelling mechanism is arranged on the outer plate; shaft plates are respectively arranged in the middle of front and back sides of a top end of the countertop, two parallel turning shafts are connected between the two shaft plates, and two second drive motors are fixedly connected to an outside of the shaft plate on one side; output shafts of the second drive motors are respectively connected to the turning shafts through couplings, and an end of the turning shafts is rotatably connected to the shaft plate on the other side; and turning frames are fixedly connected to an axial outside of the two turning shafts, a chamber is formed between the two turning frames and the countertop, and a rapid dewatering mechanism is arranged in the chamber of the countertop.

2. The deep-sea crawling robot according to claim 1, wherein the weight-increasing auxiliary crawling mechanism comprises two symmetrical water storage frames and two symmetrical mounting frames, wherein a chamber is formed when the two water storage frames are docked, and the two mounting frames are fixedly connected to side faces of the countertop respectively; a bottom of the mounting frame is hinged to a top of a hydraulic cylinder, a bottom of the hydraulic cylinder is hinged to an outside of the water storage frame, and tops of the two water storage frames are fixedly connected to rotating cylinders respectively; the two rotating cylinders are located between the two mounting frames, the rotating cylinders are respectively sleeved on fixed shafts in a rolling manner, one end of the fixed shaft is fixedly connected to the countertop, and the other end of the fixed shaft is fixedly connected to a fixed frame; and roller frames are fixedly connected to bottoms of the two water storage frames respectively, a bottom of the roller frame is provided with a plurality of ground-contact moving rollers at intervals along a crawling direction of the crawling robot, the ground-contact moving rollers are rotatably connected to the roller frames, connecting plates are fixed to the middle of the two roller frames, counterweight frames are fixed on the two connecting plates, and counterweight plates are inserted into the counterweight frames.

3. The deep-sea crawling robot according to claim 2, wherein the two roller frames, the ground-contact moving rollers on the two roller frames, the connecting plates, the counterweight frames, and the counterweight plates are all symmetrically arranged.

4. The deep-sea crawling robot according to claim 1, wherein the multifunctional propelling mechanism comprises lifting rails, a plurality of propellers and a first drive motor, wherein the two vertical lifting rails are fixed on a top surface of the outer plate, and lifting sliders are arranged in the lifting rails; a bottom of the lifting slider is connected to a bottom wall of the lifting rail through a connecting spring, the two lifting sliders are fixedly connected through a shaft bracket, and the shaft bracket is fixedly connected to an outside of the lifting slider; a rotating shaft is arranged in the shaft bracket, two ends of the shaft bracket are rotatably connected to the rotating shaft, and a rotating roller is fixed on an annular outside of the rotating shaft; and a deflection frame is fixed on an outside of the rotating roller, the plurality of propellers are arranged in the deflection frame at intervals along an axial direction of the rotating shaft, the first drive motor is fixed to one side of the shaft bracket, and an output shaft of the first drive motor is connected to the rotating shaft through a coupling.

5. The deep-sea crawling robot according to claim 1, wherein the rapid dewatering mechanism is arranged in the middle of the chamber of the countertop, the rapid dewatering mechanism comprises two hollow plates which are obliquely arranged, a support frame is arranged between the two hollow plates, and the support frame is fixed on the countertop; blowers are fixed to two sides of the support frame respectively, an air delivery end of the blower communicates with an interior of the hollow plate, a plurality of electric heating tubes are evenly arranged inside the hollow plate, and a plurality of blow holes are evenly distributed on a side, facing the chamber of the countertop, of each hollow plate; and a bottom of the countertop is evenly provided with a plurality of drainage holes.

6. The deep-sea crawling robot according to claim 1, wherein support plates are fixedly connected to two ends of a lower surface of the countertop respectively, and the support plates are fixedly connected to a top surface of the crawling robot body.

7. The deep-sea crawling robot according to claim 1, wherein extension rods are respectively fixed to front and back ends of left and right bottoms of the countertop, inner ends of the extension rods are fixedly connected to the countertop, mechanical legs are connected to bottoms of outer ends of the extension rods, and a plurality of ground-contact claws are annularly distributed at a bottom of the mechanical leg; and an annular mounting plate is fixed to an outside of the mechanical leg above the ground-contact claws, a plurality of embedded claws are evenly fixed on a bottom surface of the annular mounting plate, and the embedded claws annularly surround the ground-contact claws.

8. A crawling method of the deep-sea crawling robot according to claim 1, comprising the following steps:

S1: when the crawling robot moves forward on a sea surface, hydraulic cylinders are adjusted to drive water storage frames to rotate in a horizontal direction, so that the two water storage frames gradually move to a horizontal position, which increases a contact area between the crawling robot body and the sea surface; at this point, propellers are parallel to the outer plate, and the propellers are activated to accelerate the forward movement of the crawling robot;

S2: during the descent of the crawling robot in the sea, the hydraulic cylinders drive the water storage frames to rotate in a vertical direction, gradually closing a gap between the two water storage frames; and during the closing process, the water storage frames are filled with a large amount of seawater, and the seawater inside the chamber formed by the docked water storage frames increases the weight of the crawling robot;

meanwhile, the propellers move to the tops of lifting rails, and a first drive motor is started to drive the propellers for angle adjustment, tilting the propellers towards a seabed direction;

S3: when the crawling robot crawls on the seabed, ground-contact moving rollers and mechanical legs make contact with the seabed, and ground-contact claws and embedded claws increase a frictional force during the movement of the crawling robot; and S4: when the crawling robot works, the second drive motors are started to drive the turning frames to rotate, exposing the machinery inside the chamber of the countertop to seawater, and then the machinery starts working.

9. The crawling method according to claim 8, wherein in S2, after the propellers are started, forces in two directions are generated, a thrust force in the horizontal direction accelerates the crawling of the crawling robot when it is on the seabed, and a thrust force in the vertical direction compresses the crawling robot.

10. The crawling method according to claim 8, wherein in the deep-sea crawling robot, the weight-increasing auxiliary crawling mechanism comprises two symmetrical water storage frames and two symmetrical mounting frames, wherein a chamber is formed when the two water storage frames are docked, and the two mounting frames are fixedly connected to side faces of the countertop respectively; a bottom of the mounting frame is hinged to a top of a hydraulic cylinder, a bottom of the hydraulic cylinder is hinged to an outside of the water storage frame, and tops of the two water storage frames are fixedly connected to rotating cylinders respectively; the two rotating cylinders are located between the two mounting frames, the rotating cylinders are respectively sleeved on fixed shafts in a rolling manner, one end of the fixed shaft is fixedly connected to the countertop, and the other end of the fixed shaft is fixedly connected to a fixed frame; and roller frames are fixedly connected to bottoms of the two water storage frames respectively, a bottom of the roller frame is provided with the plurality of ground-contact moving rollers at intervals along a crawling direction of the crawling robot, the ground-contact moving rollers are rotatably connected to the roller frames, connecting plates are fixed to the middle of the two roller frames, counterweight frames are fixed on the two connecting plates, and counterweight plates are inserted into the counterweight frames.

11. The crawling method according to claim 10, wherein in the deep-sea crawling robot, the two roller frames, the ground-contact moving rollers on the two roller frames, the connecting plates, the counterweight frames, and the counterweight plates are all symmetrically arranged.

12. The crawling method according to claim 8, wherein in the deep-sea crawling robot, the multifunctional propelling mechanism comprises the lifting rails, the plurality of propellers and the first drive motor, wherein the two vertical lifting rails are fixed on a top surface of the outer plate, and lifting sliders are arranged in the lifting rails; a bottom of the lifting slider is connected to a bottom wall of the lifting rail through a connecting spring, the two lifting sliders are fixedly connected through a shaft bracket, and the shaft bracket is fixedly connected to an outside of the lifting slider; a rotating shaft is arranged in the shaft bracket, two ends of the shaft bracket are rotatably connected to the rotating shaft, and a rotating roller is fixed on an annular outside of the rotating shaft; and a deflection frame is fixed on an outside of the rotating roller, the plurality of propellers are arranged in the deflection frame at intervals along an axial direction of the rotating shaft, the first drive motor is fixed to one side of the shaft bracket, and an output shaft of the first drive motor is connected to the rotating shaft through a coupling.

13. The crawling method according to claim 8, wherein in the deep-sea crawling robot, the rapid dewatering mechanism is arranged in the middle of the chamber of the countertop, the rapid dewatering mechanism comprises two hollow plates which are obliquely arranged, a support frame is arranged between the two hollow plates, and the support frame is fixed on the countertop; blowers are fixed to two sides of the support frame respectively, an air delivery end of the blower communicates with an interior of the hollow plate, a plurality of electric heating tubes are evenly arranged inside the hollow plate, and a plurality of blow holes are evenly distributed on a side, facing the chamber of the countertop, of each hollow plate; and a bottom of the countertop is evenly provided with a plurality of drainage holes.

14. The crawling method according to claim 8, wherein in the deep-sea crawling robot, support plates are fixedly connected to two ends of a lower surface of the countertop respectively, and the support plates are fixedly connected to a top surface of the crawling robot body.

15. The crawling method according to claim 8, wherein in the deep-sea crawling robot, extension rods are respectively fixed to front and back ends of left and right bottoms of the countertop, inner ends of the extension rods are fixedly connected to the countertop, the mechanical legs are connected to bottoms of outer ends of the extension rods, and the plurality of ground-contact claws are annularly distributed at a bottom of the mechanical leg; and an annular mounting plate is fixed to an outside of the mechanical leg above the ground-contact claws, the plurality of embedded claws are evenly fixed on a bottom surface of the annular mounting plate, and the embedded claws annularly surround the ground-contact claws.

* * * * *